United States Patent [19]

Hata et al.

[11] Patent Number: 4,704,215

[45] Date of Patent: Nov. 3, 1987

[54] LUBRICANT COMPOSITION FOR TRANSMISSION OF POWER

[75] Inventors: Hitoshi Hata, Sodegaura; Hisashi Machida, Maebashi; Tomoo Ishihara, Takaidonishi, all of Japan

[73] Assignee: Idemitsu Kosan Company Limited, Tokyo, Japan

[21] Appl. No.: 899,879

[22] Filed: Aug. 25, 1986

[30] Foreign Application Priority Data

Sep. 3, 1985 [JP] Japan ..... 60-193190

[51] Int. Cl.[4] ..... C10M 187/06

[52] U.S. Cl. ..... 252/32.7 E; 252/33.2; 252/33.3; 252/51.5 A; 585/3

[58] Field of Search ..... 252/32.7 E, 51.5 A, 252/33.2, 33.3; 585/3

[56] References Cited

U.S. PATENT DOCUMENTS

| | | | |
|---|---|---|---|
| 3,835,050 | 9/1974 | Green | 585/3 |
| 3,920,562 | 11/1975 | Foehr | 252/32.7 E |
| 3,925,217 | 12/1975 | Green et al. | 585/2 |
| 4,306,984 | 12/1981 | Yamaguchi | 252/46.7 |
| 4,371,726 | 2/1983 | Horita et al. | 252/32.7 E |

*Primary Examiner*—Jacqueline V. Howard

*Attorney, Agent, or Firm*—Walter H. Schneider

[57] ABSTRACT

A lubricant composition for transmission of power consisting essentially of (A) base oil of which main component is a saturated hydrocarbon having condensed ring and/or non-condensed ring, (B) one kind or more than two kinds of zinc dithiophosphate and/or oxymolybdenum organophosphorodithioate sulfide, (C) alkenyl succinimide and (D) rust inhibitor.

14 Claims, No Drawings

LUBRICANT COMPOSITION FOR TRANSMISSION OF POWER

BACKGROUND OF THE INVENTION

This invention relates to lubricant compositions for transmission of power, and more particularly to lubricant compositions having excellent traction coefficient and wear resistance, load carrying capacity, thermal stability, oxidation stability, rust preventing property and being effectively utilized as the lubricants for power transmission having a traction drive mechanism.

In recent years, traction drive (friction driving device utilizing rolling contact) is employed as continuously variable transmission for automobile and industrial equipment, etc. As the fluid used for the traction drive, a fluid having high traction coefficient and high power transmitting efficiency is required.

Under the circumstances, a variety of proposals are made in order to obtain fluid for traction drive having high power transmitting efficiency (for example, Japanese Patent Publications Nos. 46-338, 46-339, 47-35763, 53-36105, 58-27838, Japanese Patent Laid-open Publications Nos. 55-40726, 55-43108, 55-60596, 57-78089, 57-70895, 57-155295, 57-155296, 57-162795 and the like).

It is necessary to lubricate the traction drive mechanism with single oil since said traction drive mechanism is consisted as an apparatus for transmission of power containing gear machine, oil pressure mechanism, rolling bearings, etc. in the same system.

However, the conventional fluids for the traction drive mentioned above had improved the power transmitting efficiency, but since they were proposed exclusively for the traction drive, when used at locations such as gear mechanism, oil pressure mechanism, rolling contact bearing and the like, there are such problems as the wear resistance and load carrying capacity were not sufficient, and moreover, the thermal and oxidation stability were poor, and a large amount of sludges was generated, and they could not sufficiently withstand for practical purposes.

Under the circumstances, in order to overcome the foregoing conventional problems, blending of the additives such as extreme pressure additive, antiwear agent, antioxidant to the fluid for traction drive described in the foregoing is considered.

But, when an additive such as extreme pressure additive is merely added to the fluid for traction drive, problems such as shortening the fatigue life of the traction drive mechanism or remarkably deteriorating the power transmitting efficiency or causing corrosion, and as a result, the lubricant capable of satisfying sufficiently all the characteristics which are appropriate for practical purpose has not been available.

SUMMARY OF THE INVENTION

An object of this invention is to provide lubricant compositions for transmission of power having excellent traction coefficient and high power transmitting efficiency and moreover excellent wear resistance, load carrying capacity, thermal and oxidation stability, and rust preventing property and being effectively utilized for the lubrication of the power transmission having the traction drive mechanism.

DETAILED DESCRIPTION OF THE INVENTION

This invention is to provide, in the first place, a lubricant composition for transmission of power which consists essentially of (A) a base oil whose main component is a saturated hydrocarbon having condensed ring and/or non-condensed ring, (B) one kind or more than two kinds of zinc dithiophosphate (Provided that zinc dithiophosphate of which $R^1$–$R^4$ denotes a primary alkyl group of 3–30 carbon atoms is more than 30 weight % based on the whole zinc dithiophosphate) represented by the following general formula (I)

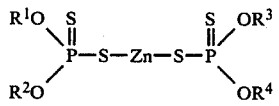

(I)

(In which $R^1$, $R^2$, $R^3$ and $R^4$ denotes a primary alkyl group of 3–30 carbon atoms, secondary alkyl group of 3–30 carbon atoms or aryl group of 6–30 carbon atoms, or alkyl group substituted aryl group. Provided that $R^1$, $R^2$, $R^3$ and $R^4$ may be the same or different.) and/or oxymolybdenum organophosphorodithioate sulfide represented by the following general formula (II)

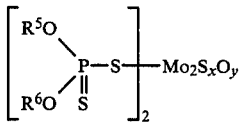

(II)

(In which $R^5$ and $R^6$ denote an alkyl group of 1–30 carbon atoms, cycloalkyl group, aryl group or alkylaryl group, and x and y denote a positive real number satisfying $x+y=4$. Provided that $R^5$ and $R^6$ may be the same or different.) (C) alkenyl succinimide or its derivative and (D) rust inhibitor.

In this invention, as (A) component, the base oil whose main component is a saturated hydrocarbon having condensed ring and/or non-condensed ring is used. As the saturated hydrocarbon mentioned above, a variety of compounds can be enumerated, but particularly, the saturated hydrocarbon having the cyclohexyl group and/or decalyl group, and the saturated hydrocarbon of 10–40 carbon atoms is preferable. As the saturated hydrocarbon having the cyclohexyl group and/or decalyl group, concretely speaking, the following compounds can be enumerated.

Namely, for example, 2-methyl-2,4-dicyclohexyl butane represented by the following formula

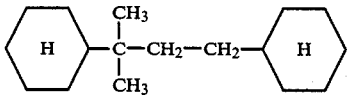

1-decalyl-1-cyclohexyl ethane represented by the following formula

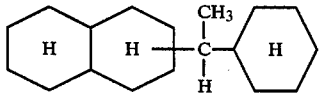

2-methyl-2,4-dicyclohexyl pentane represented by the following formula

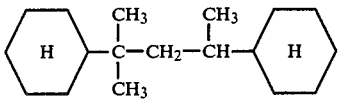

alkyl cyclohexane represented by the following formula

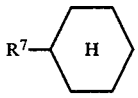

(In which $R^7$ denotes alkyl group of 10–30 carbon atoms.) can be enumerated. As the example compounds, concretely speaking, isododecylcyclohexane, isopentadecylcyclohexane and the like can be enumerated.

Besides, as the saturated hydrocarbon having condensed ring and/or non-condensed ring which is the (A) component in this invention, the following compounds can be enumerated.

Namely, 1,2-di(dimethylcyclohexyl)propane represented by the following formula

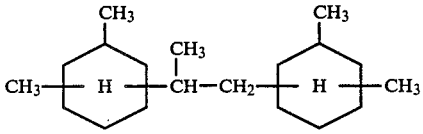

2,3-di(methylcyclohexyl)-2-methylbutane represented by the following formula

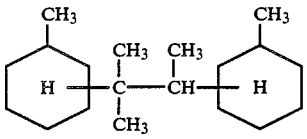

1,2-di(methylcyclohexyl)-2-methylpropane represented by the following formula

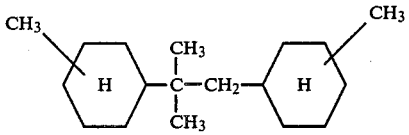

2,4-dicyclohexyl pentane represented by the following formula

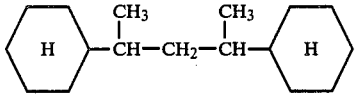

cyclohexyl methyl decalin represented by the following formula

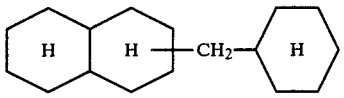

1-(methyldecalyl)-1-cyclohexyl ethane represented by the following formulas

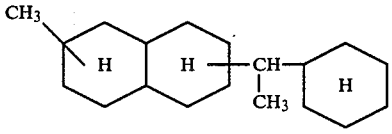

and

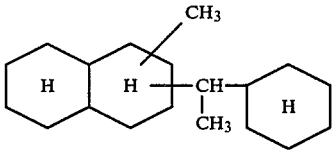

1-(dimethyldecalyl)-1-cyclohexyl ethane represented by the following formulas

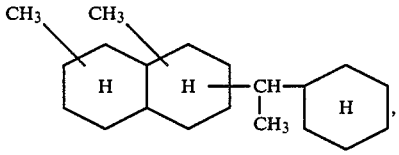

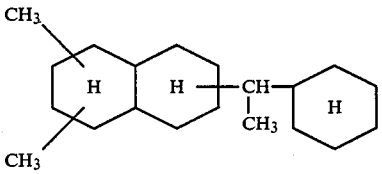

and

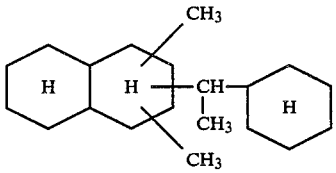

2-decalyl-2-cyclohexyl propane represented by the following formula

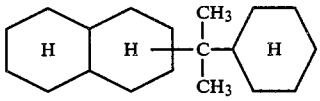

cyclohexylmethyl prehydrofluorene represented by the following formula

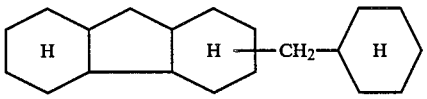

1-perhydrofluorenyl-1-cyclohexyl ethane represented by the following formula

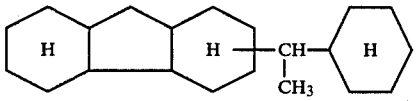

cyclohexylmethyl perhydroacenaphthene represented by the following formula

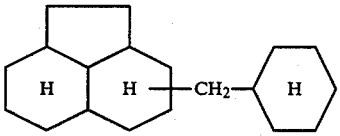

1,1.2-tricyclohexyl ethane represented by the following formula

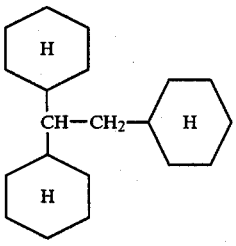

bisdecalin represented by the following formula

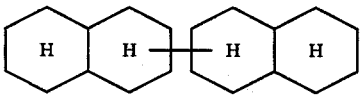

2,4,6-tricyclohexyl-2-methylhexane represented by the following formula

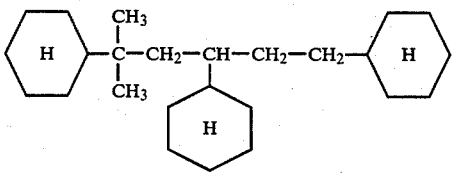

2-(2-decalyl)-2,4,6-trimethylnonane represented by the following formula

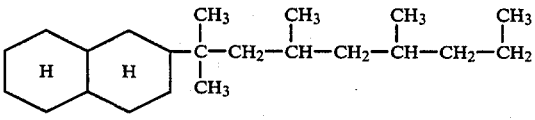

1,1-didecalyl ethane represented by the following formula

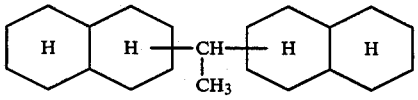

tercyclohexyl represented by the following formula

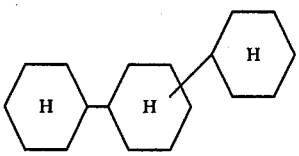

1,1,3-trimethyl-3-cyclohexyl hydrindane represented by the following formula

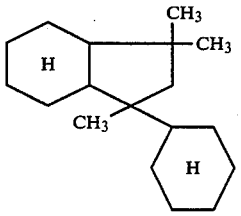

2-methyl-1,2-didecalyl propane represented by the following formula

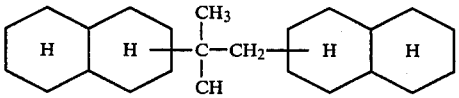

and the like can be enumerated, and they may be used singly or in combination of more than two kinds.

The (A) component in this invention is the base oil whose main component is the foregoing saturated hydrocarbon having condensed ring and/or non-condensed ring, and in addition, it may contain at a rate of less than 50%, mineral oil, particularly, naphthene mineral oil, synthetic oils such as polybutene, alkylbenzene.

Next, in this invention, as the (B) component, one kind or more than two kinds of zinc dithiophosphate represented by the general formula (I) and/or oxymolybdenum organophosphorodithioate sulfide represented by the general formula (II) is used.

The zinc dithiophosphate represented by the general formula (I) includes compound of which all the substituents of $R^1$–$R^4$ in the formula are the same to compound of which all the substituents of $R^1$–$R^4$ in the formula are different, and they may be used singly or used in combination of more than two kinds upon mixing thereof. Normally, two kinds or more than two kinds of the zinc dithiophosphate whose substituents of $R^1$–$R^4$ are same are used upon mixing thereof. However, the compound can be used singly, and also, two kinds or more than two kinds of the zinc dithiophosphates having the different four substituents of $R^1$–$R^4$ may be used singly or in combination with the zinc dithiophosphates having the same four substituents of $R^1$–$R^4$. However, in either cases, it is necessary that the zinc dithiophosphate in which $R^1$–$R^4$ denote a primary alkyl group of 3–30 carbon atoms is more than 30 weight % based on the whole zinc dithiophosphate to be used. As the foregoing zinc dithiophosphate, the compounds sold in the market may be used, for example, Lubrizol 677 (compound in which $R^1$–$R^4$ are mostly secondary hexyl group), Lubrizol 1060 (compound in which $R^1$–$R^4$ are mostly secondary alkyl group of less than 5 carbon atoms), Lubrizol 1360 (carbon in which $R^1$–$R^4$ are mostly mixture of an isobutyl group and n-amyl group), Lubrizol 1370 (compound in which $R^1$–$R^4$ are mostly alkylaryl group), Lubrizol 1395 (compound in which $R^1$–$R^4$ are mostly a primary butyl group and amyl group) sold by Nippon Lubrizol Co.), or Oloa 260 (compound in which $R^1$–$R^4$ are mostly an alkylaryl group), Oloa 267 (compound in which $R^1$–$R^4$ are mostly a primary hexyl group) sold by Shevron Chemical Corp., U.S.A., and furthermore, Santolube 393 (compound in which $R^1$–$R^4$ are mostly a secondary hexyl group) sold by Monsant Chemical Co., U.S.A., Amoco 198 (compound in which $R^1$–$R^4$ are mostly a primary butyl group and amyl group) sold by Amoco Chemical C., U.S.A. are used singly or properly in combination by adjustment so that the zinc dithiophosphate in which $R^1$–$R^4$ are a primary alkyl radical of 3–30 carbon atoms is more than 30 weight % based on the whole zinc dithiophosphate.

Also, in this invention, the oxymolybdenum organophosphorodithioate sulfide represented by the general formula (II) is used as the (B) component together with or instead of one kind or more than two kinds of the zinc dithiophosphate represented by the general formula (I). This oxymolybdenum organophosphorodithioate is manufactured by the method described in, for example, Japanese Patent Publication No. 44–27366, and as the concrete compounds, olymolybdenum di-isopropyl phosphorodithioate sulfide, oxymolybdenum diisobutyl phosphorodithioate sulfide, oxymolybdenum di(2-ethylhexyl)phosphorodithioate sulfide, oxymolybdenum di-(p-tertiary butylphenyl)phosphorodithioate sulfide, oxymolybdenum di-(nonylphenyl)phosphorodithioate sulfide and the like can be enumerated.

One kind or more than two kinds of zinc dithiophosphate represented by the general formula (I) and/or the oxymolybdenum organophosphorodithioate sulfide represented by the general formula (II) which is the (B) component of this invention is the compound having function as an extreme pressure additive (improve of load carrying capacity, wear resistance), and its blending rate is in the range of 0.1–2.0 weight % to the whole composition, and preferably 0.2–1.5 weight %. In case the blending rate is less than 0.1 weight %, the sufficient addition effect does not appear, and on the other hand, it is not possible to expect a remarkable effect even if the blending of more than 2.0 weight % is made, and inversely, showing a tendency of decreased effect.

Also, in this invention, as the (C) component, alkenyl succinimide or its derivatives is used. As alkenyl succinimide, a variety of compounds are available, and for example, many compound including OLOA-1200N, OLOA-373 made by Kalonite Chemical Co., LUBRIZOL 6406 made by Nippon Lubrizol, HITEC E-638 made by Nippon Couper Co. and the like can be enumerated.

Furthermore, as the derivative of the alkenyl succinimide, particularly, boron compound derivative is preferable. As the boron compound derivative of the alkenyl succinimide, for example, reaction product of alkenyl succinimide and boron compound (for example boric acid, borate, boric ester), a product prepared by reacting alkyl substituted succinic acid anhydride with a reaction product of alkylene amine and boron compound (described in Japanese Patent Publication No. 42-8013), a product prepared by reacting an alkylene amine with a reaction product of hydrocarbon substituted succinic acid anhydride and boron compound (described in Japanese Patent Publication No. 42-8014), prepared by reacting hydroxylated primary amine and boron compound with alkenyl succinic acid anhydride (described in Japanese Patent Laid-open Publication No. 51-52381), a product prepared by reacting boron compound with a reaction product obtained by reacting aromatic polyvalent carboxylic acid, alkenyl succinic acid and polyalkylene polyamine at a specific molar ratio (described in Japanese Patent Laid-open Publication No. 51-130408), a condensation product of aminoalcohol and boric acid and oxyethane carboxylic acid (described in Japanese Patent Laid-open Publication No. 54-87705), and a product obtained by sequentially reacting polyalkylene glycol, secondary alkanol amine and boron compound with polyalkenyl succinic acid anhydride, etc. are known. As the (C) component, the boron compound derivative of the alkenyl succinimide is particularly preferable.

The alkenyl sucinimide or its derivative, which is the (C) component, does not contain metal component and shows a function satisfactory for the dispersion of an insoluble mixture in a lubricant composition, which acts as so called dispersing agent, and its blending rate is in the range of 0.1–3.0 weight % to the whole composition, preferably, 0.2–1.0 weight %. In case, if the blending rate is less than 0.1 weight %, the addition effect is not sufficient, and also, in case it exceeds 3.0 weight %, there is not much chance for the rising of the effect.

Furthermore, in this invention as the (D) component, the rust inhibitor is used. As the rust inhibtor, various kinds of the compounds can be enumerated. For example, calcium sulfonate, barium sulfonate, sodium sulfonate and in addition, alkyl amines such alkyl or alkenyl succinic acid, its derivative, tri-n-butylamine, n-octylamine, tri-n-octylamine, cyclohexylamine or alkylamine salt or ammonium salt of carboxylic acids such as fatty acid of 6–20 carbon atoms, aromatic carboxylic acid, and dibasic acid of 2–20 carbon atoms, and furthermore, condensates of each of the carboxylic acids and amine can be enumerated. Among them, calcium sulfonate or barium sulfonate can be preferably used.

The rust inhibitor that is the (D) component is blended at a rate of 0.01–1.0 weight % to the whole composition, preferably 0.1–0.5 weight %. In case the blending rate is less than 0.01 weight %, the rust cannot be prevented, and also, in case the blending rate is more than 1.0 weight %, an improvement of the rust preventing effect cannot be anticipated, and inversely, showing a tendency of deteriorating the wear resistance which is not preferable.

The lubricant composition of this invention is composed of the foregoing (A), (B), (C) and (D) components, but furthermore, if necessary, proper amount of a variety of additives may be added. For example, phenol antioxidants such as 2,6-ditertiary butyl-p-cresol, 4,4'-methylenebis-(2,6-ditertiary butylphenol) and the like can be enumerated. Also, as the pour point depressant or viscosity index improver, polymethacrylate can be enumerated, and particularly, the polymethacrylate having number-average molecular weight 10,000–100,000 are preferable. In addition, olefin copolymers such as ethylene-propylene copolymer, styrene-propylene copolymer and the like can be used. These phenol antioxidants or pour point depressants or viscosity index improving agents are normally added by 0.1–10.0 weight % to the whole composition.

Furthermore, it is possible to use tricresyl phosphate, triphenyl phosphate, trixylenyl phosphate and the like. These compounds may be normally added to the (B) component, and particularly, in case of using the tricresyl phosphate, 0.1–1.5 weight % to the whole composition, preferably 0.2–1.0 weight % may be added.

Besides, proper amount of corrosion inhibitor, oiliness agent, extreme pressure additive, deforming agents, fatigue life improving agent and the like may be added.

The lubricant composition of this invention consisting of the foregoing component has particularly high traction coefficient, and high power transmitting efficiency.

Moreover, the lubricant composition of this invention is excellent in the wear resistance, load carrying capacity.

Furthermore, the lubricant composition of this invention is superior in the thermal stability, oxidation stability, and rust preventing property, and there are no problems such as generation of sludge or corrosion.

Accordingly, the lubricant composition of this invention can be extremely effectively used in the traction drive mechanism including the gear mechanism, oil pressure mechanism, rolling contact bearing and the like in the same system, in other words, in the lubrication of the power transmission having the traction drive mechanism.

This invention will be described in the following by referring to examples.

EXAMPLES 1–6 AND COMPARATIVE EXAMPLES 1–3:

(1) Example of Preparation 1000 g of tetralin (tetrahydronaphthalene) and 300 g of concentrated sulfuric acid were place into a flask made of glass of 3-liter capacity, and the inside temperature of the flask was cooled to 0° C. in ice bath. And then, 400 g of styrene was dropped into the solution for 3 hours while stirring thereof and the reaction was completed in one hour while stirring thereof. Thereafter, the stirring was suspended, and was allowed to stand to separate the oily layer, and this oily layer was washed with 500 cc of 1N-aqueous solution of sodium hydroxide and 500 cc of saturated solution of sodium chloride three times each, and then, it was dried by sodium sulfate anhydride. Successively, unreacted tetralin was distilled off, and then, distillation under reduced pressure was carried out to yield 750 g of fraction having boiling point of 135° C. –148° C./0.17 mmHg. As a result of analysis of this fraction, it was confirmed to be a mixture of 1-(1-tetralyl)-1-phenylethane and 1-(2-tetralyl)-1-phenylethane.

Next, 500 cc of the fraction was placed into an autoclave of 1-liter capacity, and 500 g of activated nickel catalyst for hydrogenation (trade name N-113 Catalyst made by Nikki Chemical Co.) was added, and hydrogenation processing was carried out for 4 hours in the reaction condition of hydrogen pressure of 20 kg/cm$^2$, and reaction temperature of 150° C. After the cooling, the reaction solution was filtered and the catalyst was separated. Successively, light material was stripped from the filtrate, and an analysis of the resulting product showed that a rate of hydrogenation was more than 99.9%, and also this product was confirmed to be a mixture of 1-(1-decalyl)-1-cyclohexylethane and 1-(2-decalyl)-1-cyclohexylethane. A specific gravity of the resulting mixture was 0.94 (15/4° C.), and dynamic viscosity was 4.4 cSt (100° C.), and also, refracting index $n_D^{20}$ was 1.5032.

(2) Preparation of Lubricant Composition

The lubricant composition was prepared by adding the component shown in Table 1 to the bare oil ( (A) component) at a predetermined rate, and a variety of tests were carried out on the resulting lubricant composition. The results are shown in Table 1. The method of testing is as follows.

Method of testing (1) lubricant oxidation stability test for internal combustion engine (ISOT)

The test was carried out in accordance with 3.1 of JIS K 2514 (150° C.×96 hours).

traction coefficient

The test was carried out by 2-cylinder type rolling friction testing machine. Namely, the cylinder A having a curvature (diameter 52 mm, radius of curvature 10 mm) and the cylinder B having flat surface (diameter 52 mm) were made to contact by 7000 gf, and the cylinder A was arranged to run at a fixed speed (1500 rpm) and the cylinder B was arranged to raise the speed from 1500 rpm and the traction force generated between both the cylinders at the slip rate 5% was measured to find the traction coefficient.

The quality of material of the two cylinders was bearing steel SUJ-2, and the surface was finished with buff by alumina (0.03 micron), and the surface roughness was less than $R_{max}$ 0.1 micron, and Hertz's contact pressure was 112 kgf/mm$^2$. The sample oil was kept at 100° C. by temperature control to make measurement.

(3) wear resistance

The shell four-ball test of ASTM D-4172 was carried out. (Provided that the condition was 1800 rpm×30 kg×2h·RT).

(4) load resistant performance

The test was carried out in accordance with ASTM D-2783.

(5) rust preventing property

The test was carried out in accordance with JIS K 2246.

Comparative Example 4:

The test similar to Example 1 was carried out on the fluid for the traction drive available on the market. The results are shown in Table 1.

TABLE 1

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Blended Composition | | | | | | | | | | |
| (A) Component base oil *1 | 98.2 | 98.2 | 98.2 | 97.7 | 98.2 | 97.2 | 99.2 | 98.7 | 98.2 | products on market |
| (B) Component ZnDTP 1 *2 | 1.0 | 1.0 | | 1.0 | | 1.0 | | 1.0 | | |
| MoDTP *3 | | | 1.0 | | 0.5 | 0.5 | | | | |
| ZnDTP 2 *4 | | | | | | | | | 1.0 | |

TABLE 1-continued

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| TCP *5 | | | | 0.5 | 0.5 | 0.5 | | | | |
| (C) Component boron compound derivative of alkenyl succinimide *6 | 0.5 | 0.5 | 0.5 | 0.5 | 0.5 | 0.5 | 0.5 | | 0.5 | |
| (D) Component Ba—sulfonate *7 | 0.3 | | 0.3 | 0.3 | 0.3 | 0.3 | 0.3 | 0.3 | 0.3 | |
| Ca—sulfonate *8 | | 0.3 | | | | | | | | |
| Test Result | | | | | | | | | | |
| ISOT | | | | | | | | | | |
| Kinematic viscosity ratio (40° C.) | 1.05 | 1.05 | 1.07 | 1.05 | 1.08 | 1.06 | solidification | 1.08 | 1.14 | 1.26 |
| n-pentane insoluble compound (weight %) | 0.01 | 0.01 | 0.02 | 0.01 | 0.02 | 0.01 | | 0.07 | 0.09 | 0.18 |
| Adhered material on vessel wall | no | no | no | no | no | no | | yes (a little) | | yes (a little) |
| Traction coefficient | 0.072 | 0.072 | 0.072 | 0.072 | 0.072 | 0.072 | | 0.072 | 0.072 | 0.071 |
| Initial Period | | | | | | | | | | |
| Traction coefficient | 0.073 | 0.073 | 0.073 | 0.073 | 0.072 | 0.073 | 0.074 | 0.073 | 0.073 | 0.072 |
| Wear resistance (mm) | 0.56 | 0.58 | 0.56 | 0.46 | 0.52 | 0.48 | unmeasurable | 0.56 | 0.56 | 0.54 |
| Load resistant performance (kgf) | 160 | 160 | 160 | 200 | 160 | 200 | 100 | 160 | 160 | 200 |
| Rust preventing property | no rust | no rust | no rust | no rust | no rust | no rust | no rust | no rust | no rust | rust (much) |

*1 base oil
Polymethacrylate (molecular weight 40,000) was added at a rate of 5 weight % based on the whole composition.
*2 ZnDTP ①
OLOA 267 (compound in which $R^1$–$R^4$ are mostly a primary hexyl group produced by Kalonite Chemical Co.)
*3 MoDTP
Molyvan L (R. T. Vanderbilt)
*4 ZnDTP ②
Lubrizol 677 (compound in which $R^1$–$R^4$ are mostly secondary hexyl (group produced by Nippon Lubrizol Co.)
*5 TCP
Tricresyl phosphate (Dainippon Ink & Chemicals, Inc.)
*6 boron compound derivative of alkenyl succinimide
Lubrizol-935 (Nippon Lubrizol Co.)
*7 Ba—Sulfonate
NASUL-BSN (R. T. Vanderbilt)
*8 Ca—sulfonate
Sulfol R-10 (Matsumura Oil Co.)

What is claimed is:

1. A traction drive fluid composition comprising (A) as the principal component at least one saturated hydrocarbon selected from those compounds having at least one condensed ring, those having at least one non-condensed ring and those having mixtures of condensed and non-condensed rings; (B) as an extreme pressure additive about 0.1–2.0% by wt. on the composition of at least one member selected from (a) at least one zinc dithiophosphate (b) an oxymolybdenum organophosphorodithioate sulfide and (c) mixtures thereof, said zinc dithiophosphate having the formula

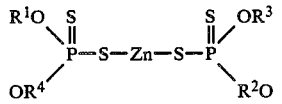

in which $R^1$, $R^2$, $R^3$ and $R^4$ may be the same or different and are selected from a primary alkyl of 3–30 carbons, a secondary alkyl of 3–30 carbons and an aryl or alkyl substituted aryl in which the aryl has 6–30 carbons and said oxymolybdenum organophosphorodithioate having the formula

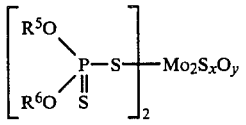

in which $R^5$ and $R^6$ may be the same or different and are selected from an alkyl of 1–30 carbons, a cycloalkyl, an aryl and an alkylaryl, and in which x+y and y are each a positive real number satisfying $x=4$ (C) as a dispersing agent about 0.1–30% by wt. on the composition of an alkenyl succinimide or a derivative thereof; and (D) about 0.01–1.0% by wt. on the composition of a rust inhibitor.

2. A composition according to claim 1 in which the saturated hydrocarbon is a condensed ring compound having a decalyl group.

3. A composition according to claim 1 in which the saturated hydrocarbon is a non-condensed ring compound having a cyclohexyl group.

4. A composition according to claim 1 in which the saturated hydrocarbon is a condensed/non-condensed ring compound having decalyl and cyclohexyl groups.

5. A composition according to claim 1 in which at least 30% by wt. of the zinc dithiophosphate is zinc dithiophosphate in which $R^1$–$R^4$ are primary alkyl groups of 3–30 carbons.

6. A composition according to claim 1 in which the dispersing agent is a boron derivative of alkenyl succinimide.

7. A composition according to claim 1 in which the rust inhibitor is selected from calicum and barium sulfonate.

8. A process for improving the coefficient of traction between at least two relatively rotatable elements in a torque transmitting relationship which comprises introducing between the tractive surfaces of said elements a traction drive fluid composition comprising (A) as the principal component at least one saturated hydrocarbon selected from those compounds having at least one condensed ring, those having at least one non-condensed ring and those having mixtures of condensed and non-condensed rings; (B) as an extreme pressure additive about 0.1–2.0% by wt. on the composition of at least one member selected from (a) at least one zinc dithiophosphate (b) an oxymolybdenum organophosphorodithioate sulfide and (c) mixtures thereof, said zinc dithiophosphate having the formula

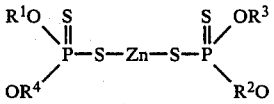

in which $R^1$, $R^2$, $R^3$ and $R^4$ may be the same or different and are selected from a primary alkyl of 3–30 carbons, a secondary alkyl of 3–30 carbons and an aryl or alkyl substituted aryl in which the aryl has 6–30 carbons and said oxymolybdenum organophosphorodithioate having the formula

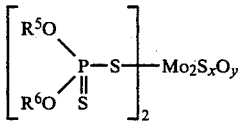

in which $R^5$ and $R^6$ may be the same or different and are selected from an alkyl of 1–30 carbons, a cycloalkyl, an aryl and an alkylaryl, and in which x and y are each a positive real number satisfying $x+y=4$ (C) as a dispersing agent about 0.1–3.0% by wt. on the composition of an alkenyl succinimide or a derivative thereof; and (D) about 0.01–1.0% by wt. on the composition of a rust inhibitor.

9. A process according to claim 8 in which the saturated hydrocarbon is a condensed ring compound having a decalyl group.

10. A process according to claim 8 in which the saturated hydrocarbon is a non-condensed ring compound having a cyclohexyl group.

11. A process according to claim 8 in which the saturated hydrocarbon is a condensed/non-condensed ring compound having decalyl and cyclohexyl groups.

12. A process according to claim 8 in which at least 30% by wt. of the zinc dithiophosphate is zinc dithiophosphate in which $R^1$–$R^4$ are primary alkyl groups of 3–30 carbons.

13. A process according to claim 8 in which the dispersing agent is a boron derivative of alkenyl succinimide.

14. A process according to claim 8 in which the rust inhibitor is selected from calcium and barium sulfonate.

* * * * *